US005307787A

United States Patent [19]

LaBorde et al.

[11] Patent Number: 5,307,787

[45] Date of Patent: May 3, 1994

[54] COMPOUND BOW HAVING OFFSET CABLE ANCHOR

[75] Inventors: Brian W. LaBorde; Allan F. Smith, both of Tucson, Ariz.

[73] Assignee: Paul E. Shepley, Jr., Tucson, Ariz.

[21] Appl. No.: 848,836

[22] Filed: Mar. 10, 1992

[51] Int. Cl.[5] ..... F41B 5/00

[52] U.S. Cl. ..... 124/25.6; 124/90

[58] Field of Search ..... 124/23.1, 25.6, 900, 124/86, 90

[56] References Cited

U.S. PATENT DOCUMENTS

| | | | |
|---|---|---|---|
| 4,202,316 | 5/1980 | Barna | 124/25.6 |
| 4,300,521 | 11/1981 | Schmitt | 124/23 R |
| 4,340,025 | 7/1982 | Caldwell | 124/86 |
| 4,440,142 | 4/1984 | Simonds | 124/25.6 |
| 4,448,183 | 5/1984 | Quartino et al. | 124/25.6 |
| 4,669,445 | 6/1987 | Schaar | 124/25.6 |
| 4,781,167 | 11/1988 | Martin | 124/25.6 |
| 4,887,582 | 12/1989 | Chatlin | 124/25.6 |
| 4,909,231 | 3/1990 | Larson | 124/25.6 |
| 4,926,833 | 5/1990 | Darlington | 124/25.6 X |

*Primary Examiner*—Randolph A. Reese

*Assistant Examiner*—Anthony Knight

*Attorney, Agent, or Firm*—Cahill, Sutton & Thomas

[57] ABSTRACT

A compound archery bow has an adjustable anchor in which a bracket having two arms is connected to the axle upon which the wheels rotate. The arms are interconnected by a translation mechanism for moveably locating the end of the cable along a path parallel to the axle. The translation mechanism is a cylindrical member having a helical groove in the outer surface thereof. The free end of the cable is looped over the cylindrical member and fastened to the cable. Rotating the cylindrical member causes the looped end of the cable to change position from side to side across the limb, permitting adjustment to minimize the net torque on the limb. Other embodiments of the translation mechanism include a pulley, parallel to the other pulleys, mounted on a threaded axle, or a threaded eyelet attached to the end of the cable and engaging a bolt connected to the two arms of the anchor bracket. A fixed anchor locates the cable at a predetermined position across the width of the limb to optimize the torques on the limbs for a given pair of wheels.

12 Claims, 2 Drawing Sheets

COMPOUND BOW HAVING OFFSET CABLE ANCHOR

BACKGROUND OF THE INVENTION

This invention relates to compound archery bows and, in particular, to an anchor for the cable in a compound bow.

Compound bows differ from long bows in that a block and tackle mechanism is used to bend the bow: pulleys or wheels are attached at the free ends of the limbs to obtain a mechanical advantage in bending the bow. The limbs can be made approximately three times as stiff as for a longbow. Eccentrically mounted wheels enable one to use a much higher maximum draw weight because they provide a substantial "let off" or reduction in the holding force of a drawn bow. The combination of stiffer limbs and greater draw weight applies large forces to the components of a compound bow.

Compound bows typically use two wheels or pulleys, with lacing wound from an anchor at one end of a first limb to the pulley at the end of the other limb, to the pulley at the first end, then back to an anchor at the other end. The middle span between the wheels contains the serving or region for receiving the nock of the arrow. As used herein, "lacing" can refer to a single piece bowstring or a three piece line comprising two end cables connected by a central stretch between the wheels which forms the bowstring. The serving is the central portion of the bowstring.

A compound bow typically has a three piece lacing. Each cable is fastened at one end to the free end of the bow limb and spans the length of the bow to wrap around the wheel at the other end of the bow. The cable exits the wheel and attaches to the bowstring by what is known as a teardrop connector. In some bows, the bowstring and cables are interconnected by the wheels.

For two wheel compound bows, the cables are anchored, i.e. have their free ends attached, to the end of the limb. In some cases, the end of the cable is simply looped over the axle upon which the wheels rotate. In other cases, a simple fitting connects the cable end to the axle upon which the wheels rotate. In still other cases, a U-shaped bracket has its arms attached to each end of the axle upon which the wheels rotate. The base of the U is attached to the end of the cable. The U-shaped bracket is typically made from metal. U.S. Pat. No. 4,300,521 discloses a bracket in the form of a short length of cable in a loop wound half way around an idler pulley. The ends of the short cable are attached to the axle. The end of the cable from the lacing is attached to the idler pulley. In all cases, the anchor is placed arbitrarily, i.e. without regard to the forces on the end of the limb.

The need arises not only to attach the ends of the cables to the limbs but also to avoid having the cables and bowstring rub and wear each other; such rubbing could result in inconsistent operation of the bow. Thus, the cables and string must be spaced slightly so that they are not coplanar. The wheels or pulleys at the ends of the limbs turn on a single axle, to which the anchor for the end of the cable is also attached. Thus, these components are spread out along the axle across the width of the limb.

The substantial forces involved combined with the spacing of the bowstring and cables at the ends of the limbs cause torques on the free ends of the limbs which twist the limbs. To further complicate the matter, the torques vary as the bowstring is drawn and released. In general, the tension on the bowstring is greatest when the bow is at rest and least when the bow is fully drawn. The situation is reversed in the cables: the tension is least when the bow is at rest and greatest when the bow is drawn. As a result of these changing forces, the ends of the limbs twist one way and then the other as the bow is fired such that the axles of the wheels are no longer perpendicular to the bowstring.

The torque on the end of each limb is a net torque, the result of three components: the two cables and the bowstring. Since the wheel receiving a first cable, the wheel receiving the bowstring, and the anchor for the second cable are spread out along the axle, there is a moment arm, i.e. a distance from a fixed reference point, associated with each element. Mathematically, any reference point could be chosen but the longitudinal center of the axle is convenient because it makes it easier to visualize balancing the moments.

The forces (tension) in the cables and the bowstring combined with their respective distances from center are the respective moments of these elements. The net torque from these moments tends to twist the respective limbs; however, the limbs resist twisting. This counteracts the net torque and the limbs stop twisting at some point, e.g. ten degrees of twist. As used herein, "net torque" refers to the resultant torque from the cables and the bowstring, as described above.

In view of the foregoing, it is therefore an object of the invention to provide a means for adjusting the net torque on the ends of the limbs of a compound archery bow.

Another object of the invention is to provide a means for minimizing the net torque on the end of the limbs of a compound archery bow.

A further object of the invention is to provide a means for setting the zero net torque point to any place in the draw range of a compound archery bow.

Another object of the invention is to provide a means for minimizing the average net torque on the ends of the limbs of a compound archery bow as it is drawn and fired.

SUMMARY OF THE INVENTION

The invention achieves the foregoing objects by providing an adjustable anchor means comprising a bracket having two arms connected to the axle upon which the wheels rotate. The arms are interconnected by a translation means for moveably locating the end of the cable along a path parallel to said axle. In a preferred embodiment of the invention, the translation means comprises a cylindrical member having a helical groove in the outer surface thereof. The free end of the cable is looped over the cylindrical member and fastened to the cable. Rotating the cylindrical member causes the looped end of the cable to change position from side to side across the limb, thereby permitting adjustment to minimize the net torque on the limb. Other embodiments of the translation means include a pulley, parallel to the other pulleys, mounted on a threaded axle, or a threaded eyelet attached to the end of the cable and engaging a bolt connected to the two arms of the anchor bracket. In accordance with another aspect of the invention, a fixed anchor is provided for locating the cable at a predetermined position to optimize the torques on the limbs for a given pair of wheels.

A more complete understanding of the invention can be obtained by considering the following detailed description in conjunction with the accompanying drawings in which.

Figure 4:
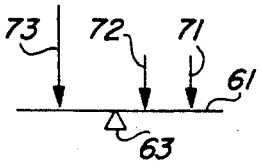

FIG. 4 schematically illustrates the torques on the end of a limb of a compound bow at rest.

Figure 5:
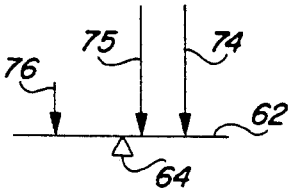

FIG. 5 schematically illustrates the torques on the end of a limb of a fully drawn compound bow.

Figure 6:
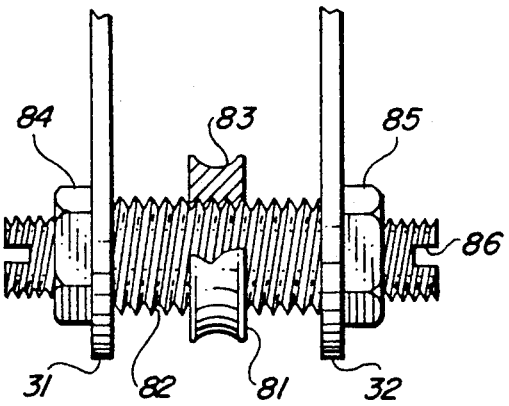

FIG. 6 illustrates a translation means comprising a pulley on a threaded axle.

Figure 7:
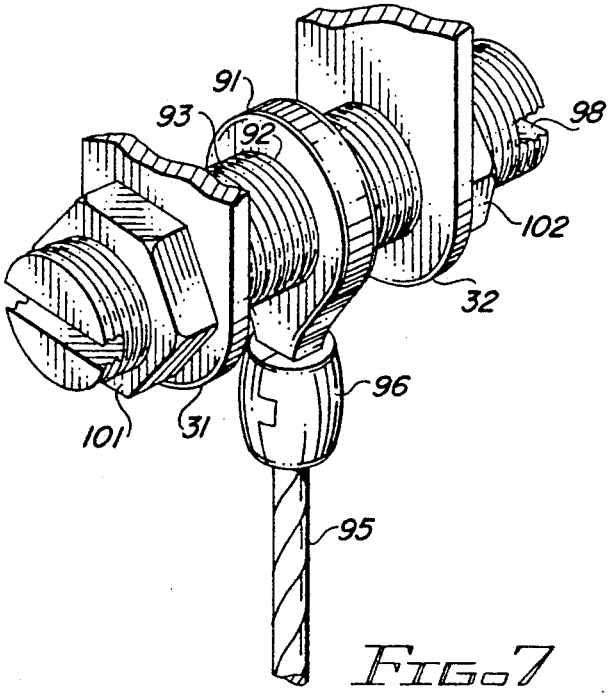

FIG. 7 illustrates a translation means comprising a threaded eyelet on a threaded shaft.

Figure 8:
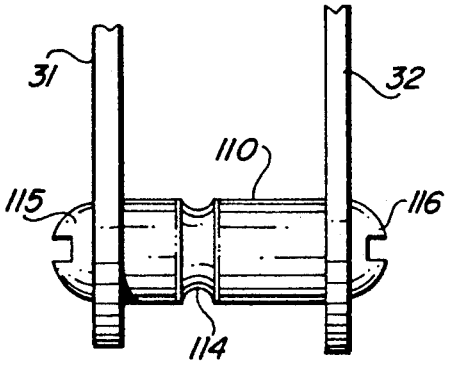

FIG. 8 illustrates an anchor constructed in accordance with an alternative embodiment of the invention.

DETAILED DESCRIPTION

Figure 1:
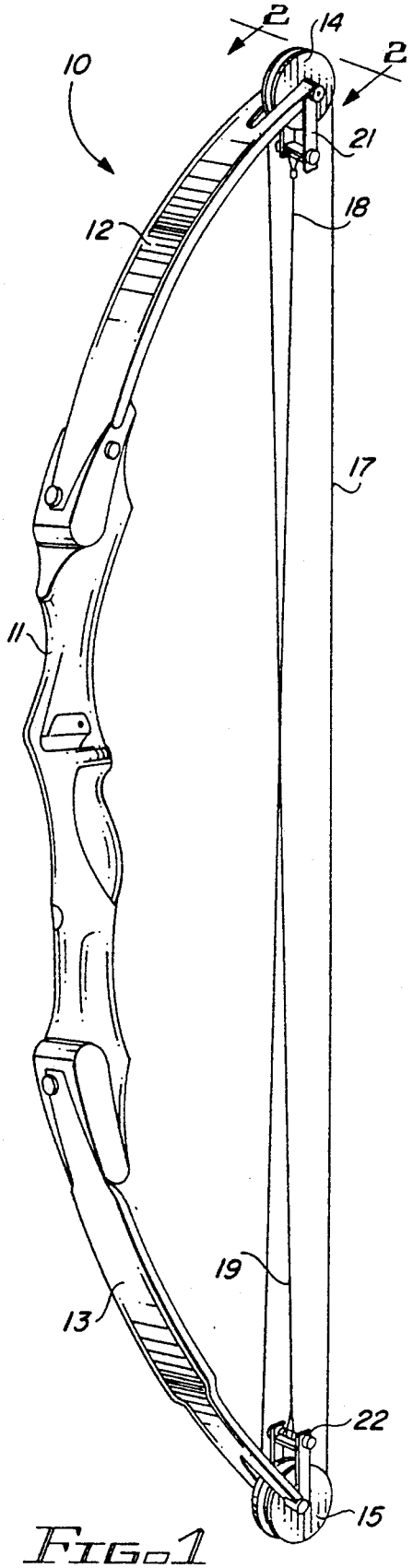
FIG. 1 illustrates a compound bow having cable anchors constructed in accordance with the invention.

In FIG. 1, compound bow 10 includes handle 11 having limbs 12 and 13 attached thereto. Pulleys or wheels 14 and 15 are mounted on axles attached to the free ends of limbs 12 and 13, respectively. Lacing, comprising bowstring 17 and cables 18 and 19 interconnect wheels 14 and 15. Specifically, bowstring 17 has one end connected to cable 18 by way of wheel 15 and the other end connected to cable 19 by wheel 14. The free end of cable 18 is connected to limb 12 by anchor 21. The free end of cable 19 is connected to limb 13 by anchor 22.

Figure 2:
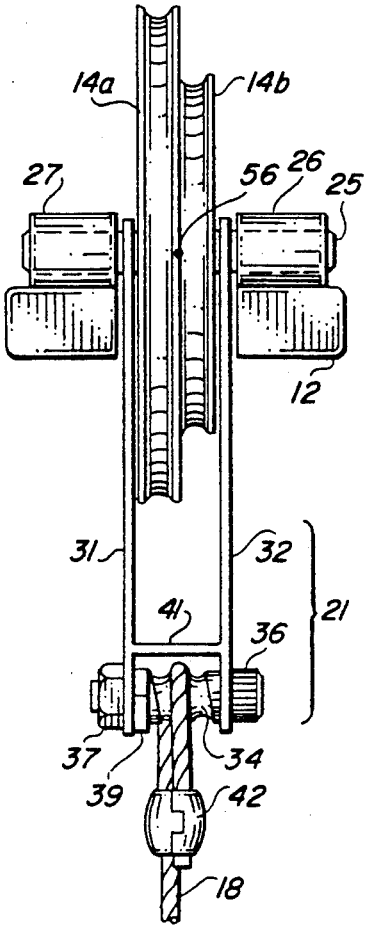
FIG. 2 illustrates a cable anchor constructed in accordance with the invention.

FIG. 2 is an end view of limb 12, showing anchor 21 in greater detail. Wheels 14*a* and 14*b* are eccentrically mounted on axle 25 which is attached to the end of limb 12 by caps 26 and 27 which are glued or otherwise fastened to the end of limb 12. Wheel 14*a* receives bowstring 17 and wheel 14*b* receives cable 19.

Cable 18 is attached to limb 12 by a clevis or bracket having arms 31 and 32 connected to axle 25. The other ends of arms 31 and 32 are connected by a translation means in the form of cylindrical member 34 having a helical groove in the outer surface thereof. The longitudinal axis of member 34 is parallel to the longitudinal axis of axle 25. Member 34 is attached to arms 31 and 32 by bolt 36 and nut 37, which also act as a clamp to prevent unwanted rotation of member 34. Member 34 preferably has facets 39 formed therein to facilitate adjustment. Bridge 41 also connects arm 31 to arm 32 and can be located at any convenient place along the length of the arms.

Arms 31 and 32 preferably comprise steel or aluminum. Member 34 preferably comprises brass. The choice of materials is a matter of design, keeping in mind that the bow is likely to be used outdoors in inclement weather.

In use, the end of cable 18 is curved back on itself to form a loop and is fastened by ferrule 42. Member 34 is inserted into the loop and then attached to the bracket by bolt 36 and nut 37. Nut 37 is not tightened so much that member 34 cannot rotate. With the bow at rest, member 34 is rotated via facets 39 to translate cable 18, i.e. to move cable 18 from side to side, so as to vary the moment arm of the force coupled by the bracket to the end of limb 12. The adjustment will minimize the net torque on the limb or move the zero net torque point to any desired point in the draw. This adjustment is best understood by considering FIGS. 3–5. After the adjustment, nut 37 is tightened to hold member 34 in place.

Figure 3:
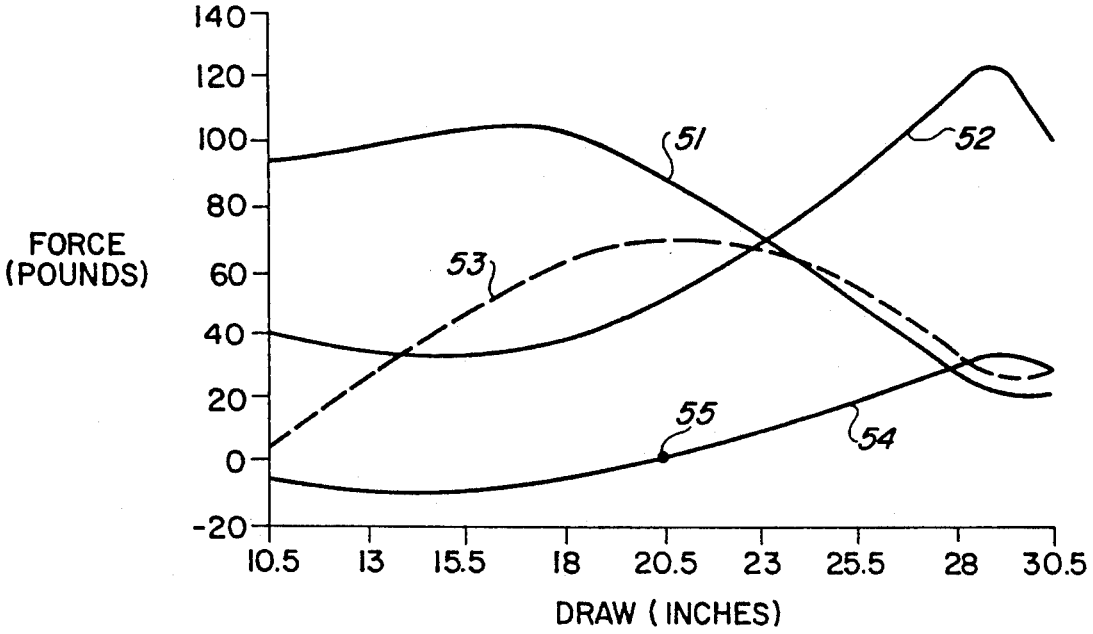
FIG. 3 is a chart for comparing different forces encountered in firing a compound bow.

FIG. 3 contains four curves illustrating some of the forces in a bow during actual operation. The abscissa (x-direction) is the draw, i.e. the distance from the handle to the center of the bowstring. The ordinate (y-direction) is force.

Curve 51 represents the tension on the bowstring. Generally speaking, the tension on the bowstring is greatest at rest, decreasing as the bow is drawn. The tension initially increases slightly in curve 51 due to the action of the particular wheels on the bow used to obtain the data. Curve 52 represents the tension on a cable. Generally speaking, the tension is initially lower and increases as the bow is drawn. The slight initial decrease and the decrease at the right-hand end of the curve are caused by the action of the wheels on the particular bow used to Obtain the data. Curve 53 represents the draw force of the bow (the force applied by the archer). Curve 54 represents the net torque on the end of limb 12. This curve represents the sum of the moments about a reference point, e.g. center point 56 in FIG. 2. A negative net torque is defined as causing a counter-clockwise rotation. A positive net torque is therefore defined as causing a clockwise rotation. The directions are arbitrary.

Note that curves 51 and 52 represent tension in the bowstring and one cable. The tension in the second cable (not shown) would be represented by a curve identical or very similar to curve 51. Also, these curves represent forces only, not distance. Curve 55 represents the sum of the moments of the bowstring and both cables for given locations of the anchor point and the two wheels. The curves will vary slightly for other bows, wheels, and spacings but the relationship of the forces remains the same.

FIGS. 4 and 5 illustrate the component moments of the cables and bowstring in a compound bow. In the figures, an axle for the wheel is represented by lines 61 and 62. Fulcrums 63 and 64 are located at the middle of their respective lines. At rest (FIG. 4), the torques of the cables, represented by arrows 71 and 72 are less than the torque of the bowstring, represented by arrow 73. Thus, there is a negative net torque on the axle and the end of the limb, as seen in FIG. 2, rotates counter-clockwise. At full draw, illustrated in FIG. 5, the torques of the cables, represented by arrows 74 and 75, are greater than the torque from the bowstring, represented by arrow 76. This produces a positive net torque on the axle and the end of the limb, as seen in FIG. 2, rotates clockwise. By moving the anchor point of the cable, in effect moving arrow 71 (and arrow 74) sideways, one can minimize the net torque on the limb.

As shown in FIG. 3, the point of attachment for the cables can be adjusted in accordance with the invention so that the net torque is zero at any point in the draw, such as at point 55, at the peak draw force of the bow. At this setting, the net torque increases significantly at full draw. This is not critical since the arrow is at rest at that point. Also, initially after release, the arrow is not undergoing maximum acceleration.

Alternatively, the point of attachment for the cables can be adjusted to minimize the average net torque on the limbs. This attempts to minimize the maximum absolute value of the net torque, hence the amount of tilt in the wheels during shooting. This point of attachment may or may not locate the point of zero net torque at maximum draw force.

Whichever adjustment is made, the goal is to enable consistent performance by the bow, which will enable the archer to be more consistent. These adjustments are made empirically when the bow is "tuned," i.e. set up for the particular archer. Tuning includes several steps, well known in the art. Adjusting the anchor points is preferably done after the other steps are completed since it may be affected by adjustments of draw length and draw weight.

FIG. 6 illustrates an alternative translation means in the form of a cylindrical, internally threaded member for receiving the looped end of the cable. Specifically, wheel 81 has an internal thread for engaging threaded shaft 82. The rim of wheel 81 preferably has groove 83 formed therein for receiving the looped end of the cable. Shaft 82 is parallel to the axle at the end of the limb and is connected to arms 31 and 32 by nuts 84 and 85. The ends of shaft 82 are reduced for receiving nuts 84 and 85 to provide shoulders for locating arms 31 and 32. Further, the ends of shaft 82 are provided with slots 86 for turning the shaft. Other means can be used for turning shaft 82 if desired.

The operation of the embodiment of FIG. 6 is similar to that of FIG. 2. Shaft 82 is rotated to translate wheel 81 from side to side, thereby adjusting the anchor point of the cable. After adjustment, nuts 84 and 85 are tightened to hold shaft 82 in place and, hence, hold wheel 81 in place. Wheel 81 will not turn of itself because the cable is looped around it.

FIG. 7 illustrates another translation means in the form of a threaded eyelet attached to the end of the cable. Specifically, eyelet 91 contains threaded bore 92 for engaging threaded shaft 93. Shaft 93 is held parallel to the axle on the end of the limb. One end of eyelet 91 is attached to cable 95, for example by ferrule 96 compressed around the ends of the eyelet and the cable. One or, preferably, both ends of shaft 93 are adapted for turning the shaft, e.g. by slot 98.

The operation of the embodiment of FIG. 7 is similar to that of FIG. 6. Shaft 93 is rotated to translate eyelet 91 from side to side, thereby adjusting the anchor point of the cable. After adjustment, nuts 101 and 102 are tightened to hold shaft 93 in place and, hence, hold eyelet 91 in place.

FIG. 8 illustrates an anchor for presetting the anchor point, e.g. for minimum average net torque. This point is neither at each end of the axle nor at the middle, but is determined by the maximum draw force and wheels used. For popular bow weights and wheel sets, an anchor preset to the optimum location simplifies tuning the bow for the average user yet gives him the benefit of optimal settings.

As shown in FIG. 8, arms 31 and 32 are connected by internally threaded, cylindrical member 110 having a longitudinal axis parallel to longitudinal axis of the axle for the wheels. Groove 114 follows a circumference of cylindrical member 110 and receives the looped end of a cable, or a fitting attached to the free end of a cable. Screws 115 and 116 hold member 110 in place. The side to side placement of groove 114 is determined at the factory from tests of bows having a particular set of wheels and draw weight. The wheels and anchors are kept as a set, sold either on a bow or separately as a kit for upgrading existing bows.

The invention thus provides a means for fine tuning a bow by adjusting the net torque on the ends of the limbs. The net torque can be minimized and the point of zero net torque can be adjusted for any place in the draw range of the bow.

Having thus described the invention, it will be apparent to those of skill in the art that various modifications can be made within the scope if the invention. For example, while the arms of the anchor bracket are illustrated as parallel, they need not be. The translation means can be wider or narrower than the combined thicknesses of wheels 14*a* and 14*b*. Arms 31 and 32 can engage axle 25 at the extremities thereof instead of closely about the wheels or be attached to the limb itself. The translation means can have either a left-hand or a right-hand thread. Bolt 36 can be threaded its entire length or can be smooth most of its length, to provide a journal closely fitting within member 34, and threaded only at its end.

What is claimed is:

1. In a compound archery bow having a handle, first and second limbs each having a first end connected to said handle and a pulley rotatable on an axle connected to a second end of each limb, a first cable for connecting the first limb to the pulley at the end of the second limb, a second cable for connecting the second limb to the pulley on the end of said first limb, and a bowstring interconnecting the pulleys, the improvement comprising:

adjustable anchor means, attaching said first and second cables to respective second ends of said first and second limbs, for translating the connection point of said cables in a direction parallel to the axle on the second end of each limb, thereby varying the net torque on said second ends.

2. The bow as set forth in claim 1 wherein said adjustable anchor means comprises:

translation means connected to the end of each cable; and bracket means connecting said translation means to respective axles;

wherein the translation means can move the end of the cable connected thereto along a path parallel to its respective axle so that the moment arm of the force coupled by said bracket means can be varied.

3. The bow as set forth in claim 2 wherein said translation means comprises:

a rotatable, cylindrical member having a helical groove in the outer surface thereof for receiving the end of said cable.

4. The bow as set forth in claim 3 and further comprising a journal, connected to said bracket means, upon which said member can rotate.

5. The bow as set forth in claim 2 wherein said translation means comprises:

a rotatable cylindrical member having a groove about an outer circumference thereof for receiving the end of said cable and an axial, threaded bore; and bolt means engaging said threaded bore and said bracket means for attaching said member to said bracket means.

6. The bow as set forth in claim 5 wherein said member comprises a wheel parallel to said pulleys.

7. The bow as set forth in claim 2 wherein said translation means comprises a threaded eyelet and bolt means engaging said threaded eyelet and said bracket means for attaching said eyelet to said bracket means.

8. Adjustable anchor means for connecting a cable to the end of a limb of a compound archery bow having a pulley mounted on an axle near the end of said limb comprising:

translation means connected to the end of said cable for moving the end of said cable along a path parallel to said axle so that the net torque along said axle can be varied; and bracket means connecting said translation means to said limb.

9. The adjustable anchor means as set forth in claim 8 wherein said bracket means connects said translation means to said axle.

10. The adjustable anchor means as set forth in claim 8 wherein said translation means comprises:

a rotatable, cylindrical member having a helical groove in the outer surface thereof for receiving the end of said cable.

11. The adjustable anchor means as set forth in claim 8 wherein said translation means comprises:

a rotatable cylindrical member having a groove about an outer circumference thereof for receiving the end of said cable and an axial, threaded bore; and bolt means engaging said threaded bore and said bracket means for attaching said member to said bracket means.

12. The bow as set forth in claim 8 wherein said translation means comprises a threaded eyelet and bolt means engaging said threaded eyelet and said bracket means for attaching said eyelet to said bracket means.

* * * * *